United States Patent [19]

Reutter

[11] 4,379,470

[45] Apr. 12, 1983

[54] CLOSING CAP, PARTICULARLY FOR A MOTOR VEHICLE RADIATOR

[75] Inventor: Heinrich Reutter, Waiblingen, Fed. Rep. of Germany

[73] Assignee: Reutter Metallwarenfabrik GmbH, Fed. Rep. of Germany

[21] Appl. No.: 239,552

[22] Filed: Mar. 2, 1981

[30] Foreign Application Priority Data

Mar. 1, 1980 [DE] Fed. Rep. of Germany ..... 3008002

[51] Int. Cl.[3] ..... F16K 17/196

[52] U.S. Cl. ..... 137/493.8; 137/530; 137/543.19; 220/204; 220/206

[58] Field of Search ..... 137/493, 493.7, 493.8, 137/530, 543.19; 220/203, 204, 206

[56] References Cited

U.S. PATENT DOCUMENTS

| | | | |
|---|---|---|---|
| 2,521,166 | 9/1950 | Hinrichs | 137/530 |
| 2,788,092 | 4/1957 | Whisler | 137/530 X |
| 2,904,065 | 9/1959 | Butlin | 137/543.19 X |
| 3,601,154 | 8/1971 | Demler | 137/543.19 X |
| 3,913,615 | 10/1975 | Cooper | 137/543.19 X |

FOREIGN PATENT DOCUMENTS

| | | | |
|---|---|---|---|
| 2710982 | 9/1978 | Fed. Rep. of Germany | 137/493.8 |
| 941700 | 11/1963 | United Kingdom | 220/203 |

*Primary Examiner*—Robert G. Nilson

*Attorney, Agent, or Firm*—McGlew and Tuttle

[57] ABSTRACT

In the housing of a closing cap 2, a valve seat plate 3 is held in place by means of a resilient ring 8 forming at the same time a seal relative to the tank connection to which the closing cap is screwed by its internal thread 1. The valve seat plate 3 supports a sub-pressure valve 4 and an excess-pressure valve 5. Aside from its seal ring 13, the closing member 4 of the sub-pressure valve is made in one piece.

The excess-pressure valve 5 comprises a loose valve disc 28 cooperating with a valve seat 27 of the valve seat plate 3. The closing spring 30 is non-rotatably secured to the valve disc 28 and bears by its other open end against a stop 37 so that, by turning the valve disc, the spring pressure is increased or reduced. For this purpose, the valve disc is actuated by a tool introduced through the outlet aperture 21. In another embodiment, a setting member 40 is provided which is rotatable in the outlet aperture and can be displaced in the axial direction of the valve by means of two mating helicoidal surfaces 38, 39.

11 Claims, 4 Drawing Figures

CLOSING CAP, PARTICULARLY FOR A MOTOR VEHICLE RADIATOR

FIELD AND BACKGROUND OF THE INVENTION

The invention relates to a closing cap, particularly for the radiator of a motor vehicle, comprising an excess-pressure valve and a sub-pressure valve mounted in a valve seat plate, with the sub-pressure valve including a valve disc which is secured to a valve tappet extending through the valve seat and which cooperates with the sub-pressure valve seat of the valve seat plate.

Such pressure-type caps are known per se. Due to the construction of the excess-pressure valve of prior art caps, however, their locking member tends to occupy an oblique position so that varying pressures are obtained in a system equipped with such a closing cap, for example, in the cooling system of a motor vehicle. Since a valve stem is used for the valve disc of the excess-pressure valve, the cross-section area of flow is unfavorable and the needed weight rate of the fluid flow is not always ensured. On the other hand, for various reasons, the size of the prior art closing cap cannot either, or can hardly be, enlarged. Another drawback is that, in a series of locking caps of this kind, the pressure to which at least the excess-pressure valve is responsive, varies so that upon an exchange of the cap, a higher or lower pressure in the radiator, etc. may be obtained. As a rule, and in general, not only in prior art closing caps, the sub-pressure valve is less problematic.

The invention is directed to a closing cap in accordance with the preamble of claim 1 in which the excess pressure valve closes securely under any circumstances and always ensures the needed weight rate of the fluid flow within the provided range.

To this end the invention provides the features set forth in the characterizing part of claim 1. Since a valve stem is omitted, no angular tilt can occur and a perfect closing is ensured. In addition, the space formerly occupied by a valve stem is now available for a larger, thus more favorable, cross-sectional area of flow. Consequently, the excess-pressure valve does not tend to a slow and uncontrolled opening, and the full cross-sectional area of flow is instantly free at an excess pressure, which is required particularly if a closing cap for a motor vehicle radiator is concerned.

In a development of the invention, it is provided that the retaining member is formed with a locking flange cooperating with a locking groove of the valve seat plate, and that the aperture is provided in the bottom of the retaining member. The fluid under excess pressure which penetrated into the excess-pressure valve through an aperture in the valve seat plate, flows out through this aperture. Because of the locking connection between the retaining member and the valve seat plate, the excess-pressure valve can very quickly and easily be mounted. It is also rapidly accessible at any time. In another development, the invention provides that the aperture is rimmed on its inward side with a toroidal flange serving as a centering shoulder for the associated end of the closing spring which is designed as a helical compression spring. This ensures that the aperture is continually available without any limitation and is not even partly covered by the spring. Moreover, the centering of this spring ensures a quite satisfactory contact pressure between the valve disc and its seat, and a centric force application to the valve disc in the open position.

According to an advantageous development of the invention, the excess-pressure valve seat is provided at the bottom of a cup-shaped, box-like extension of the valve seat plate, projecting in the direction of the rim of the closing cap, and a plurality of strips or the like, for guiding the valve disc having a circular circumference, is provided inside the wall of the box-like extension and, particularly, regularly distributed over the circumference. In their circumferential direction, the guide strips are of a width such that they both ensure a guidance and leave sufficiently large flow channels. The total cross-sectional area of the flow channels between the guide strips should be at least equal to the inlet area of the excess-pressure valve. The flow through the channels then also contributes to a satisfactory centering of the valve disc. In addition, experience has shown that this design of the excess pressure valve ensures a complete opening of the valve in the shortest time so that it is superior to any other construction.

Advantageously, the valve disc is provided, on either of its sides, with a stud-shaped of tubular projection, with a seal ring being clamped onto one of the projections, and the fittingly shaped end of the closing spring being clamped to the other projection. This facilitates the assembly of the excess-pressure valve since the closing spring and the seal ring can be put in place on the valve disc in advance and then inserted as a unit.

As mentioned, prior art closing caps have the disadvantage that, within a series, the values, particularly of the actuating pressure of the excess-pressure valve, may vary considerably from each other, and that with the given tolerances, the major part does not satisfy the requirements on dimension. A rework, if at all possible, is very expensive. Therefore, the invention is further directed to a closing cap with which the values required for the opening pressure of the excess-pressure valve can better be ensured. For this purpose, in accordance with a further development of the invention, the projection of the valve disc is provided with at least one engaging or receiving element for a driving tool engageable therewith, and the retaining member is provided, particularly on its centrally apertured cup bottom, with a stop for the open spring end bearing thereon, with the engaging or receiving element being located substantially in alignment with the aperture of the retaining member. The engaging or receiving element of the valve disc can be reached by a proper tool through the aperture of the retaining member. The valve disc can thus be turned about its central axis by the tool from the outside. Since the respective end of the closing spring is clamped to the valve disc, the spring turns along. The upper spring end bearing against the stop is free. Therefore, the contact pressure between the valve disc and its seat only depends on what portion of the last turn of the spring at the free end thereof bears against the stop. If the closing spring is now turned through the valve disc by the tool, this pressure can be increased or reduced. The actuating pressure of the excess-pressure valve can thus be adjusted in a particularly simple way and expeditiously, and a relatively simple tool can be used. For example, the tool may be a pipe with a slotted end, with a cross-bar at its other end. In such an instance, it is particularly advantageous if with a tubular projection of the valve disc receiving the associated end of the spring, two engaging elements offset through 180° are provided in the interior of the tubular projection.

Still another advantageous development of the invention is that the bottom facing the closing spring of the retaining member of the excess-valve is provided with a helicoidal surface engaging with a mating helicoidal surface of a setting member which is received for rotary motion in the retaining member and bears against the associated end of the spring, and is provided with an engaging element through which it can be rotated, or with a receiving part for such an element. In this embodiment, the spring end associated with the retaining-member, does not bear thereagainst directly, but through the special setting member. This member is substantially tubular and has an outwardly projecting flange on which the helicoidal mating surface is provided. At an excess pressure, the escaping fluid flows through this setting member which is received by its outer circumference in the aperture of the retaining member. In addition, the setting member is provided, particularly on its somewhat outwardly projecting end, with an element for engaging an actuating tool, more particularly with a hexagonal recess. The setting member may also be equipped directly with a handle. The extension and pitch of the helicoidal surfaces determine the range within which the closing spring can be tensioned or relieved. The helicoidal surface may extend through 360°, for example, so that upon fully turning the closing spring, the spring is relieved by an amount corresponding to the pitch of the helicoidal surface. An unintentional relief caused by the setting member turning back can easily be prevented by choosing an appropriate material, pitch, or friction in the seat. It is also possible, in accordance with a further development of the invention, to provide that the helicoidal surfaces are stepped or have saw toothlike faces, so that any particular measure at other locations preventing the rotation may be omitted. With such a design, the setting occurs in steps, which is by no means disadvantageous since the tolerance range is sufficiently wide and, as a rule, the adjustment requires turning through more than one step.

Another advantageous embodiment of the invention is that the projecting end of the valve tappet of the sub-pressure valve is provided with an enlarged head, preferably of conical shape, forming a bearing shoulder for the smaller-base end of a frustoconical helical compression spring whose larger-base end bears against the valve seat plate. Making the valve tappet and valve disc in one piece not only reduces expenses but also allows more precision in manufacture than if two pieces connected with each other are used, as in the prior art.

Some embodiments of the invention are shown in the drawings in which.

Figure 1:
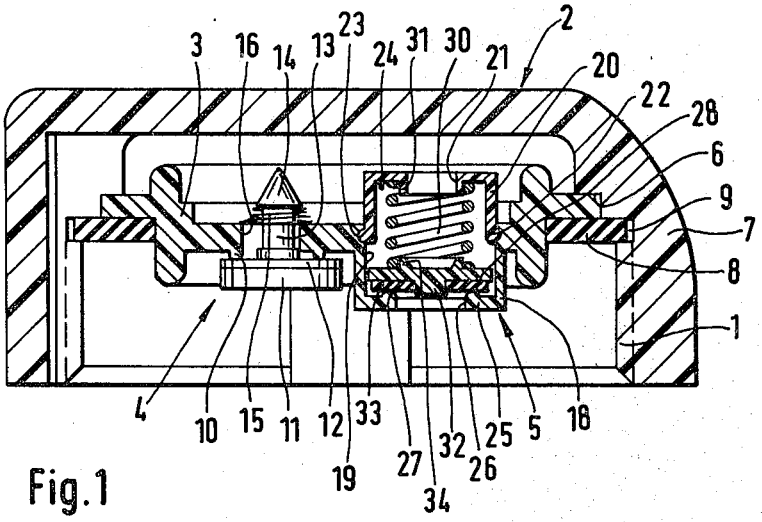
FIG. 1 is a vertical sectional view of a closing cap.

The closing cap 2, provided with an internal thread 1, is screwed to an externally threaded connection (not shown) of a motor vehicle radiator. The valve seat plate 3 of the cap supports a sub-pressure valve 4 and an excess-pressure valve 5. The outer rim of plate 3 bears against a shoulder 6 of the cap housing 7 and is held in place by means of a resilient ring 8. The ring is clamped into a groove 9 of housing 7 and serves not only as a securing element for plate 3 but also as a seal between cap 2 and the front face of the radiator connection. On its closed side, housing 7 is designed as a cross-or star-like structure, which may be indirectly learned from FIG. 1.

Figure 2:
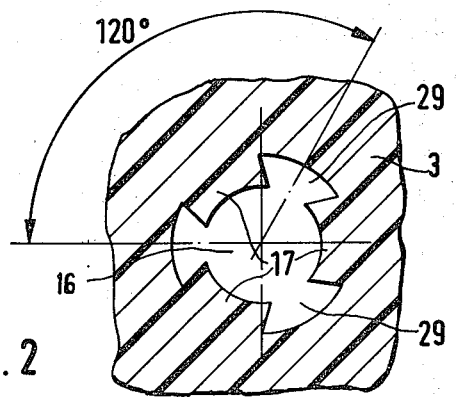
FIG. 2 is an enlarged sectional view of the casing of an excess-pressure valve at the level of the valve disc.

The valve seat 10 of sub-pressure valve 4 is preferably formed as an integral portion of valve seat plate 3. It cooperates with a valve disc 11 of valve 4, which may carry a seal ring 12. Valve disc 11 is preferably made in one piece with a valve tappet 13 having its free end designed with an enlarged conical head 14. This provides a shoulder for the frustoconical helical compression spring 15 bearing by its smaller base end against the shoulder and by its larger base end against valve seat plate 3. Opening 16 through which the fluid, namely air in the present example, can flow in the event of a sub-pressure, has a cross-section corresponding to that shown in FIG. 2. Preferably, three guide strips 17 equidistantly offset by 120° project into the otherwise circular cross-section area. The cup-shaped box-like extension 18 of valve seat plate 3 forming a part of the casing of excess-pressure valve 5 has the same inner contour 19 as opening 16. This is not shown in FIG. 1.

The casing of excess-pressure valve 5 is formed by the aforementioned cup-shaped box-like extension 18, on the one hand, and by the retaining member 20, which is also cup-shaped, on the other hadn. However, with a longer box-like extension 18, a flat disc may also be used instead of cup-shaped retaining member 20. An aperture 21 must, of course, also be provided in such a flat disc, as in cup-shaped retaining member 20. In any case, a locking connection with valve seat plate 3 is provided in addition. For this purpose, an outwardly projecting locking edge 22 is formed on the free rim of retaining member 20, which engages in a locking groove 23 of valve seat plate 3. Not only a bottom 24 of retaining member 20 but also bottom 25 of box-like extension 18 is provided with an aperture 26 forming the inlet of excess-pressure valve 5. Aperture 21 forms the outlet of the excess-pressure valve.

Excess-pressure valve 5 includes a loose plate-shaped valve disc 28 cooperating with a valve seat 27 which is formed on bottom 25 of cup-shaped box-like extension 18 of valve seat plate 3. While being displaced, valve disc 28 is guided by guide strips 17 between which passage channels 29 for the fluid flowing out are formed. A closing spring 30 designed as a helical compression spring bears by one its end against valve disc 28 and by its other end against the bottom 24 of retaining member 20. This other end of the spring is fixed by a toroidal flange 31 forming a centering extension, on the one hand, and a part of aperture 21, on the other hand. The toroidal extension is formed inside on bottom 24 of retaining member 20. The retaining member as well as the other parts, with the exception of the springs and seal rings, are made of a plastic.

Figure 3:
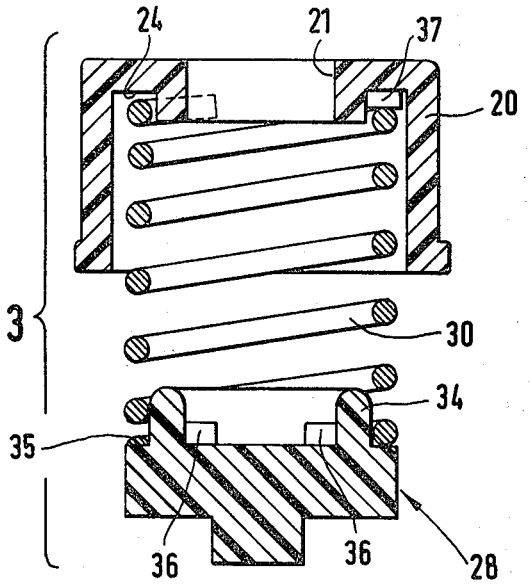
FIG. 3 is an enlarged view of another embodiment of a portion of an excess-pressure valve similar to the excess-pressure valve shown in FIG. 1.

Valve disc 28 carries a stud-shaped or tubular projection on both its sides. Stud-shaped projection 32 holds a seal ring 33 fast while tubular projection 34 on the opposite side serves to firmly hold in place the associated end of closing spring 30. This spring end is designed to fit circumferentially as shown in FIG. 3.

Projection 34 of valve disc 28, which serves to firmly hold in place one end 35 of closing spring 30, as mentioned, is provided with at least one and preferably two, engaging elements 36 for a turning tool (not shown). The tool is introduced through aperture 21 and may be embodied, for example, as a pipe which is slotted on its lower end so that the slots engage on the two engaging elements 36. Since valve disc 28 and closing spring 30 are non-rotatably connected to each other, closing spring 30 can be turned about its longitudinal axis by means of this tool. The upper end of the spring projecting into retaining member 20 is free and bears against a pad-or strip-shaped stop 37 which is formed on the bottom 24 of retaining member 20. It may be easily understood that by rotating it in one direction, the spring can be tensioned, and by rotating it in the other direction, the tension of the spring can be reduced. This makes it possible to adjust the spring pressure in an assembled excess-pressure valve 5 in a simple manner, quickly and exactly.

Figure 4:
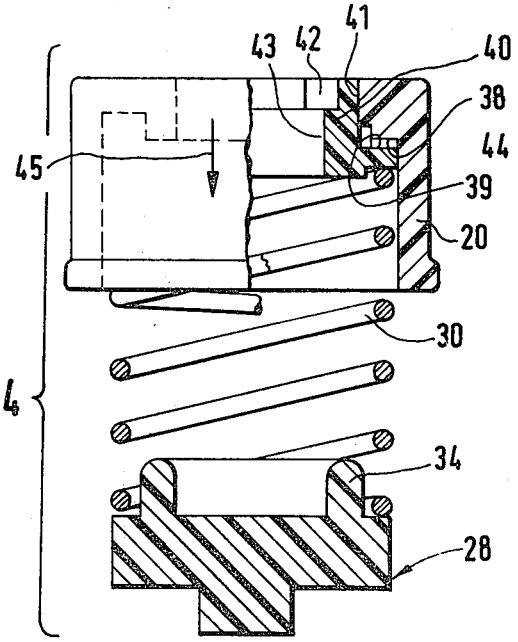
FIG. 4 is a view corresponding to FIG. 3 and showing a third embodiment.

A similar adjusting arrangement is provided in the embodiment shown in FIG. 4. A helicoidal surface 38 is provided on the bottom of retaining member 20 facing the closing spring 30 of excess-pressure valve 5, and a mating surface 29 which is also helicoidal is provided on a setting member 40. The associated end of closing spring 30 bears against setting member 40, particularly against an outer flange thereof, thereby pressing the two helicoidal surfaces into contact with each other. Setting member 40 is supported for rotation in a bore 41 of retaining member 20. In addition, setting member 40 is provided with a centric receiving element 42 into which a rotary actuating element is to be engaged. The actuating element may be a hexagon spanner, for example, and the receiving element 42 then takes the shape of a hexagonal recess. Central bore 43 of setting member 40 serves as the outlet aperture of the excess pressure valve. The spring end bearing against setting member 40 is preferably circumferentially closed. Since the contact surface 44 of the outer flange of setting member 40 extends in a plane which is perpendicular to the central axis of closing spring 30, a turning of setting member 40 relative to retaining member 20 results in a displacement of the setting member, for example, in the direction of arrow 45, and consequently, in a tensioning of closing spring 30. Analogously, turning in the opposite direction relieves the pressure by the spring. This arrangement makes it possible to adjust excess-pressure valve 5 quickly in a very simple and reliable manner. The mechanism may be made self-locking or at least made with a sufficiently high frictional resistance, to avoid an uncontrolled displacement.

In a manner not shown, notches are worked in helicoidal surfaces 38 and 39 so that step-or saw-tooth-like contacting faces are produced. This eliminates an unintentional resetting, and the displacement is effected by small steps. The initial position is easily reached again by turning through more than 360°.

I claim:

1. A removable motor vehicle radiator closing cap for a vehicle cooling system, comprising, a cap housing having an open end, a resilient valve seat plate extending across said housing and dividing it vertically into a closed top space and a bottom space adjacent the opened end, an excess pressure valve mounted in said plate including a cup-shaped extension portion having an excess pressure opening extending through said seat plate, an excess pressure valve seat defined around the excess pressure opening, an excess pressure valve disc engageable on said valve seat to close the excess pressure opening, a top cover member overlying said excess pressure valve disc and having a top bearing face with a top opening, an excess pressure spring biased between said disc and said bearing face and urging said valve disc toward said excess pressure valve seat, a sub-pressure valve mounted in said plate including a sub-pressure opening through said plate, a sub-pressure valve seat defined around said sub-pressure opening, a sub-pressure valve including a disc portion engageable with the sub-pressure valve seat and having a tappet portion extending through the sub-pressure opening, and a sub-pressure spring biased between said valve seat plate and said tappet urging said disc portion onto said sub-pressure valve seat.

2. A closing cap, according to claim 1, wherein said top cover member comprises a separate member having a locking flange, said valve seat plate having a locking groove into which said flange extends.

3. A closing gap, according to claim 2, wherein said top cover member includes a flange bounding said top opening providing a centering shoulder, said excess pressure valve spring comprising a helical compression spring having an end guided on said flange.

4. A closing cap, according to claim 1, wherein the excess pressure opening is defined by wall portions of said plate in the form of a plurality of circumferentially spaced, radially extending strips, providing guides for said excess pressure valve seat.

5. A closing cap, according to claim 4, wherein said excess pressure valve disc is provided with a tubular projection, said excess pressure spring being a helical spring having a portion engaged with said projection.

6. A closing cap, according to claim 1, wherein said excess pressure spring comprises a helical spring engageable with said excess pressure disc and said top cover member, said top cover member and said disc being relatively rotatable to vary the tension on said spring.

7. A closing cap, according to claim 6, wherein said top cover member has a stop thereon engaged with the excess pressure valve spring, said excess pressure valve disc having a driving tool engagement portion which may be engaged by a driving tool to rotate it relative to said top cover member to vary the tension of said spring.

8. A closing cap, according to claim 1, wherein said excess pressure valve disc includes a tubular projection, said excess pressure spring comprising a helical spring engageable with the tubular projection, said projection having two tool engagement elements thereon offset through 180° for engagement with a driving tool.

9. A closing cap, according to claim 1, wherein said top cover member includes a helicoid spring engagement surface, said excess pressure spring including a mating helicoidal surface, said excess pressure disc and said spring being relatively rotatable to vary the tension on said spring.

10. A closing cap, according to claim 9, wherein the helicoidal surfaces are provided with stepped areas defining detent positions between the surfaces.

11. A closing cap, according to claim 1, wherein said tappet portion of said sub-pressure valve is provided with an enlarged headportion having a conical shape with a bearing shoulder on the side thereof facing said disc portion, said sub-pressure spring comprising a frusto-conical helical spring having a large base portion bearing against the valve disc and a small portion engaged with said bearing shoulder.

* * * * *